US006722946B2

(12) United States Patent
Talieh et al.

(10) Patent No.: US 6,722,946 B2
(45) Date of Patent: Apr. 20, 2004

(54) ADVANCED CHEMICAL MECHANICAL POLISHING SYSTEM WITH SMART ENDPOINT DETECTION

(75) Inventors: Homayoun Talieh, San Jose, CA (US); Bulent M. Basol, Manhattan Beach, CA (US)

(73) Assignee: NuTool, Inc., Milpitas, CA (US)

( * ) Notice: Subject to any disclaimer, the term of this patent is extended or adjusted under 35 U.S.C. 154(b) by 0 days.

(21) Appl. No.: 10/197,090

(22) Filed: Jul. 15, 2002

(65) Prior Publication Data

US 2003/0153245 A1 Aug. 14, 2003

Related U.S. Application Data

(63) Continuation-in-part of application No. 10/052,475, filed on Jan. 17, 2002.
(60) Provisional application No. 60/389,244, filed on Jun. 17, 2002.

(51) Int. Cl.[7] ..... B24B 49/00
(52) U.S. Cl. ..... 451/8; 451/5; 451/41; 451/59; 451/288; 451/296
(58) Field of Search ..... 451/5, 8–10, 28, 451/41, 59, 287–289, 296, 303, 307, 513

(56) References Cited

U.S. PATENT DOCUMENTS 5,605,760 A 2/1997 Roberts
5,762,536 A * 6/1998 Pant et al. ..... 451/6
5,800,248 A * 9/1998 Pant et al. ..... 451/41
5,916,012 A * 6/1999 Pant et al. ..... 451/41
6,025,015 A 2/2000 Landry-Coltrain et al.
6,103,628 A * 8/2000 Talieh ..... 451/63
6,146,248 A 11/2000 Jairath et al.
6,155,915 A * 12/2000 Raeder ..... 451/285
6,241,583 B1 6/2001 White
6,244,935 B1 6/2001 Birang et al.
6,248,000 B1 6/2001 Aiyer
6,261,959 B1 7/2001 Travis et al.
6,336,845 B1 * 1/2002 Engdahl et al. ..... 451/41
6,352,470 B2 * 3/2002 Elledge ..... 451/285
6,406,363 B1 6/2002 Xu et al.
6,413,873 B1 * 7/2002 Li et al. ..... 438/711
6,416,385 B2 * 7/2002 Ferri et al. ..... 451/10
6,475,070 B1 11/2002 White
6,503,131 B1 * 1/2003 Franklin et al. ..... 451/296
6,517,418 B2 * 2/2003 Engdahl et al. ..... 451/41

* cited by examiner

*Primary Examiner*—Joseph J. Hail, III
*Assistant Examiner*—David B. Thomas
(74) *Attorney, Agent, or Firm*—NuTool Inc. Legal Department

(57) ABSTRACT

The methods and systems described provide for an in-situ endpoint detection for material removal processes such as chemical mechanical polishing (CMP) performed on a workpiece. In a preferred embodiment, an optical detection system is used to detect endpoint during the removal of planar conductive layers using CMP. An optically transparent polishing belt provides endpoint detection through any spot on the polishing belt. Once endpoint is detected, a signal can be used to terminate or alter a CMP process that has been previously initiated.

19 Claims, 10 Drawing Sheets

ADVANCED CHEMICAL MECHANICAL POLISHING SYSTEM WITH SMART ENDPOINT DETECTION

CROSS REFERENCE TO RELATED APPLICATIONS

This is a continuation-in-part U.S. Ser. No. 10/052,475, filed Jan. 17, 2002 and currently pending, and claims priority to Prov. No. 60/389,244 filed on Jun. 17, 2002, all incorporated herein by reference.

FIELD

The present invention relates to manufacture of semiconductor integrated circuits and more particularly to a method of chemical mechanical polishing of conductive layers using smart endpoint detection.

BACKGROUND

Conventional semiconductor devices generally include a semiconductor substrate, usually a silicon substrate, and a plurality of sequentially formed dielectric interlayers such as silicon dioxide and conductive paths or interconnects made of conductive materials. Copper and copper alloys have recently received considerable attention as interconnect materials because of their superior electromigration and low resistivity characteristics. Interconnects are usually formed by filling copper in features or cavities etched into the dielectric interlayers by a metallization process. The preferred method of copper metallization process is electroplating. In an integrated circuit, multiple levels of interconnect networks laterally extend with respect to the substrate surface. Interconnects formed in sequential layers can be electrically connected using vias or contacts. In a typical process, first an insulating layer is formed on the semiconductor substrate. Patterning and etching processes are performed to form features such as trenches and vias in the insulating layer. After coating features on the surface with a barrier and then a seed layer, copper is electroplated to fill the features. However, the plating process, in addition to the filling the features, also results in a copper layer on the top surface of the substrate. This excess copper is called overburden and it should be removed before the subsequent process steps.

FIG. 1A shows an exemplary portion 8 of such plated substrate 9, for example a silicon wafer. It should be noted that the substrate 9 may include devices or other metallic and semiconductor sections, which are not shown in FIG. 1A for the purpose of clarification. As shown in FIG. 1A, features such as a vial 0, and a trench 12 are formed in an insulation layer 14, such as a silicon dioxide layer, that is formed on the substrate 9. The via and the trench 12 as well as top surface 15 of the insulation layer 14 are covered and filled with a deposited copper layer 16 through an electroplating process. Conventionally, after patterning and etching, the insulation layer 14 is first coated with a barrier layer 18, typically, a Ta or Ta/TaN composite layer. The barrier layer 18 coats the via and the trench as well as the surface 15 of the insulation layer to ensure good adhesion and acts as a barrier material to prevent diffusion of the copper into the semiconductor devices and into the insulation layer. Next a seed layer (not shown), which is often a copper layer, is deposited on the barrier layer. The seed layer forms a conductive material base for copper film growth during the subsequent copper deposition. As the copper film is electroplated, the deposited copper layer 16 quickly fills the via 10 but coats the wide trench 12 and the top surface 15 in a conformal manner.

When the deposition process is continued to ensure that the trench is also filled, a copper layer or overburden is formed on the substrate 9. Conventionally, after the copper plating, various material removal processes, for example, chemical mechanical polishing (CMP), etching or electroetching, can be used to remove the unwanted overburden layer.

The CMP process conventionally involves pressing a semiconductor wafer or other such substrate against a moving polishing surface that is wetted with a polishing slurry. The slurries may be basic, neutral or acidic and generally contain alumina, ceria, silica or other hard abrasive ceramic particles. The polishing surface is typically a planar pad made of polymeric materials well known in the art of CMP. Some polishing pads contain abrasive particles (fixed abrasive pads). These pads may be used in conjunction with CMP solutions that may not contain any abrasive particles. The polishing slurry or solution may be delivered to the surface of the pad or may be flowed through the pad to its surface if the pad is porous. During a CMP process a wafer carrier holds a wafer to be processed and places the wafer surface on a CMP pad and presses the wafer against the pad with controlled pressure while the pad is rotated. The pad may also be configured as a linear polishing belt that can be moved laterally as a linear belt. The process is performed by moving the wafer against the pad, moving the pad against the wafer or both as polishing slurry is supplied to the interface between the pad and the wafer surface.

As shown in FIG. 1B, CMP is first applied to reduce the thickness of the copper layer down to the barrier layer 18 that covers the top surface 15 of the insulation layer 14. Subsequently, the barrier layer 18 on the top surface is removed to confine the copper and the remaining barrier in the vias 10, 12 and trenches 13. However, during these processes, determining the polishing endpoint, whether the copper layer is polished down to the barrier layer or the barrier layer is polished down to the insulation layer, is one of the important problems in the industry.

U.S. Pat. No. 5,605,760 describes a polishing pad that is made of solid uniform polymer sheet. The polymer sheet is transparent to light at a specified wavelength range. The surface of the polymer sheet does not contain any abrasive material and does not have any intrinsic ability to absorb or transport slurry particles.

More recently, endpoint detection systems have been implemented with rotating pad or linear belt systems having a window or windows in them. In such cases as the pad or the belt moves, it passes over an in-situ monitor that takes reflectance measurements from the wafer surface. Changes in the reflection indicate the endpoint of the polishing process. However, windows opened in the polishing pad can complicate the polishing process and may disturb the homogeneity of the pad or the belt. Additionally, such windows may cause accumulation of polishing byproducts and slurry.

Therefore, a continuing need exists for a method and apparatus which accurately and effectively detects an endpoint on a substrate when the substrate is polished using the CMP processes.

As shown in FIG. 1B, CMP is first applied to reduce the thickness of the copper layer down to the barrier layer 18 that covers the top surface 15 of the insulation layer 14. Subsequently, the barrier layer 18 on the top surface is removed to confine the copper and the remaining barrier in the via 10 and trench 12. However, during these processes, uniform reduction of the thickness of the polished copper layer is one of the important problems in the industry. The thickness uniformity of the metal layer must be maintained while it is processed so that the overpolish after copper endpoint is minimized and the substrate is not over-polished, since overpolishing may cause excessive dishing, erosion and other defects. Further, underpolishing of the copper layer and barrier layers may cause electrical shorts or other defects. The non-uniformity during the polishing process may be due to either a non-uniform polishing process or a non-uniform thickness of the metal layers on the substrate or both.

A uniform polishing process will significantly reduce CMP cost while increasing process throughput. As the wafer sizes become larger, e.g., 300 mm and beyond, a planar reduction of thickness in a uniform manner becomes more difficult due to the larger surface area of the wafer.

Consequently, there is need for an improved method and apparatus for monitoring and maintaining the uniformity of the polished layer when the substrate is polished using CMP processes.

SUMMARY

The present invention advantageously provides an in-situ method and apparatus for performing endpoint detection for material removal processes such as CMP.

A second embodiment includes a system that provides an advanced chemical mechanical polishing (CMP) system with smart endpoint detection.

A chemical mechanical polishing (CMP) apparatus for polishing a surface of a workpiece and for detecting a CMP endpoint is presented according to an aspect of the present invention. The CMP apparatus includes an optically transparent polishing belt, a workpiece holder, a support plate, and an optical detection system. The polishing belt, preferably including abrasive particles, polishes the surface of the workpiece and is movable in one or more linear directions. The workpiece holder supports the workpiece and is configured to press the workpiece against the polishing belt. The support plate is adapted to support the polishing belt as the workpiece is pressed against the polishing belt. The optical detection system detects the CMP endpoint and is disposed below the polishing belt. The optical detection system includes a light source and a detector. The light source sends outgoing signals through the support plate and the polishing belt to the surface of the workpiece. The detector receives incoming reflected signals from the surface of the workpiece through the polishing belt and the support plate.

A method of polishing a surface of a workpiece and of detecting a chemical mechanical polishing (CMP) endpoint is presented according to another aspect of the present invention. According to the method, the workpiece is pressed against an optically transparent polishing belt. The polishing belt is supported by a support plate. The surface of the workplace is polished with the polishing belt. The polishing belt is movable in one or more linear directions. Outgoing optical signals are sent from a light source through the support plate and the polishing belt to the surface of the workpiece. The light source is disposed below the polishing belt so that the polishing belt is between the light source and the surface of the workpiece. Incoming reflected optical signals are received from the surface of the workpiece through the polishing belt and the support plate at a detector. The detector is disposed below the polishing belt.

A method of polishing one or more workpieces and of providing chemical mechanical polishing (CMP) endpoint detection is presented according to a further aspect of the present invention. According to the method, an optically transparent polishing belt is provided between a supply area and a receive area. The polishing belt has a first end and a second end and a polishing side and a backside. The first end initially comes off the supply area and is connected to the receive area and the second end remains connected to the receive area. A first workpiece is polished by moving a portion of the polishing belt in one or more linear directions within a polishing area. A first CMP endpoint of the first workpiece is detected using an optical detection system. The optical detection system sends outgoing signals to and receives incoming reflected signals from the first workpiece through the polishing belt. The polishing belt is located between the optical detection system and the first workpiece.

A CMP apparatus for polishing a surface of a workpiece and for detecting a CMP endpoint is presented according to another aspect of the present invention. The CMP apparatus includes a supply spool and a receiving spool, an optically transparent polishing belt, a processing area, a means for moving a section of the polishing belt in one or more linear directions, and a means for detecting a CMP endpoint. The polishing belt has two ends. One end is attached to the supply spool and the other end is attached to the receiving spool. The processing area has a section of the polishing belt in between the two ends. The means for detecting the CMP endpoint sends optical signals to, and receives reflected optical signals from, the surface of the workpiece through the polishing belt. The polishing belt is located between the means for detecting and the workpiece.

A method of polishing a surface of a workpiece and of detecting a CMP endpoint is presented according to a further aspect of the present invention. According to the method, the workpiece is supported such that the surface of the workpiece is exposed to a section of an optically transparent polishing belt in a processing area. The surface of the wafer is polished by moving the section of the polishing belt bidirectional linearly. A CMP endpoint is determined for the workpiece by sending outgoing optical signals through the polishing belt to the workplace and continuously examining the relative intensity of incoming optical signals reflected from the workpiece and received through the polishing belt. The foregoing discussion of aspects of the invention has been provided only by way of introduction. Nothing in this section should be taken as a limitation on the following claims, which define the scope of the invention.

A second exemplary embodiment of the invention includes a polishing station having a workpiece holder, and a flexible polishing pad (e.g. polishing belt). The polishing pad is held against the workpiece by a platen that supplies a fluid against the backside of the pad. The platen includes a number of holes for supplying the fluid and also includes a number of sensors that can detect the endpoint of the workpiece processing. The holes are grouped together to create pressure zones and typically one sensor is associated with each zone, but there may be more or less. A computer receives the sensor signals and controls the fluid flow to optimize the polishing. If, for example, a certain location on the workpiece reaches the endpoint, the computer reduces the fluid flow to that location while maintaining the fluid flow to other areas.

In one aspect of the invention, the fluid controller independently controls the fluid flow to the pressure zones. One feature of this aspect is that the invention can also selectively exhaust fluid from certain holes in the platen to reduce, and even negatively influence, the pressure zones.

In another aspect of the invention, the workpiece is rotated during processing and the platen holes are located concentrically and each concentric ring represents a pressure zone.

In another aspect of the invention, the fluid controller independently controls the fluid flow to the concentric rings on the platen.

In another aspect of the invention, the belt is optically transparent.

In another aspect of the invention, the belt includes windows.

In another aspect of the invention, the sensors are light sensors.

In another aspect of the invention, the sensors are acoustic thickness sensors.

In another aspect of the invention, the sensors use fiber optic threads.

In another aspect of the invention, the workpiece is kept substantially stationary, but may be rotationally and translationally moved during the polishing process. In a preferred aspect of the invention, the translational movement is smaller than a pressure zone area.

Advantages of the invention include the ability to optimally polish the workpiece, thereby saving time and money.

BRIEF DESCRIPTION OF THE DRAWINGS

The foregoing and other features, aspects, and advantages will become more apparent from the following detailed description when read in conjunction with the following drawings, wherein.

DETAILED DESCRIPTION

As will be described below, the present invention provides a method and a system for an in-situ endpoint detection for material removal processes such as CMP. Reference will now be made to the drawings wherein like numerals refer to like parts throughout.

A. Endpoint Detection System

Figure 1A:
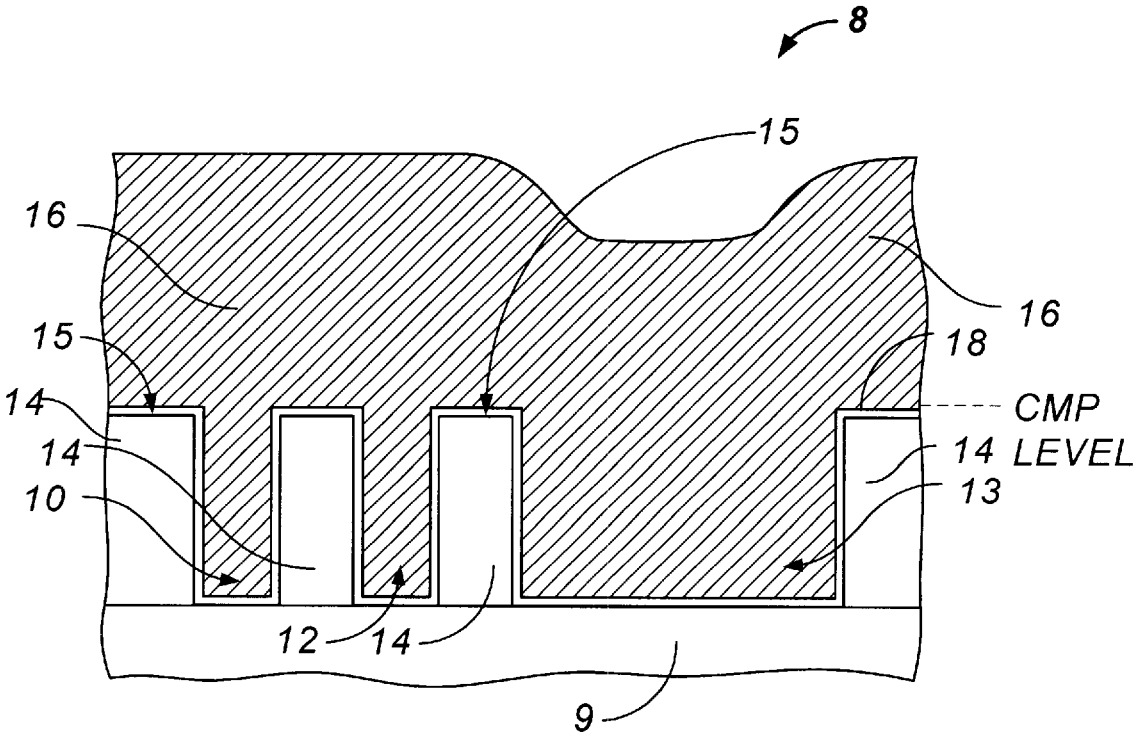
FIG. 1A is a diagram illustrating a cross-sectional view of an exemplary substrate following deposition of material onto the surface of the substrate.
Figure 1B:
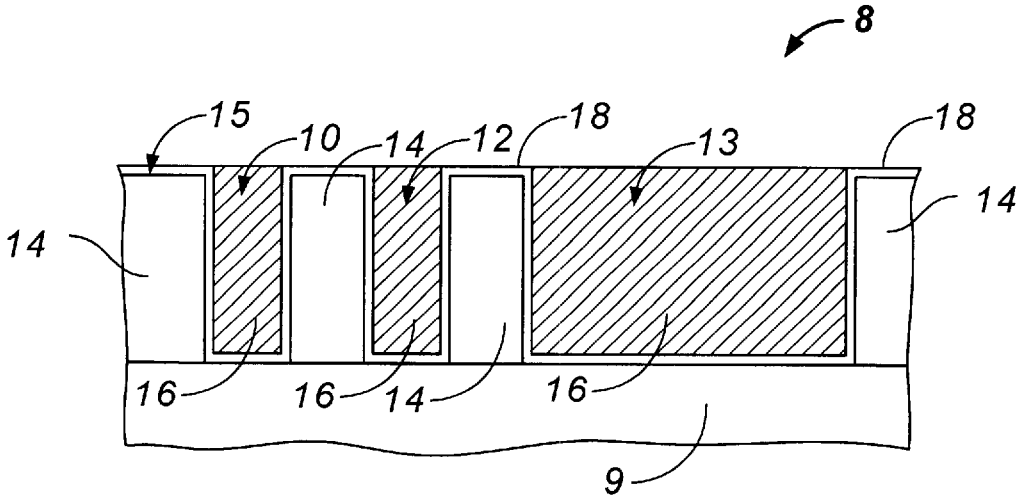
FIG. 1B is a diagram illustrating a cross sectional view of the exemplary substrate of FIG. 1 following a conventional CMP process.
Figure 2:
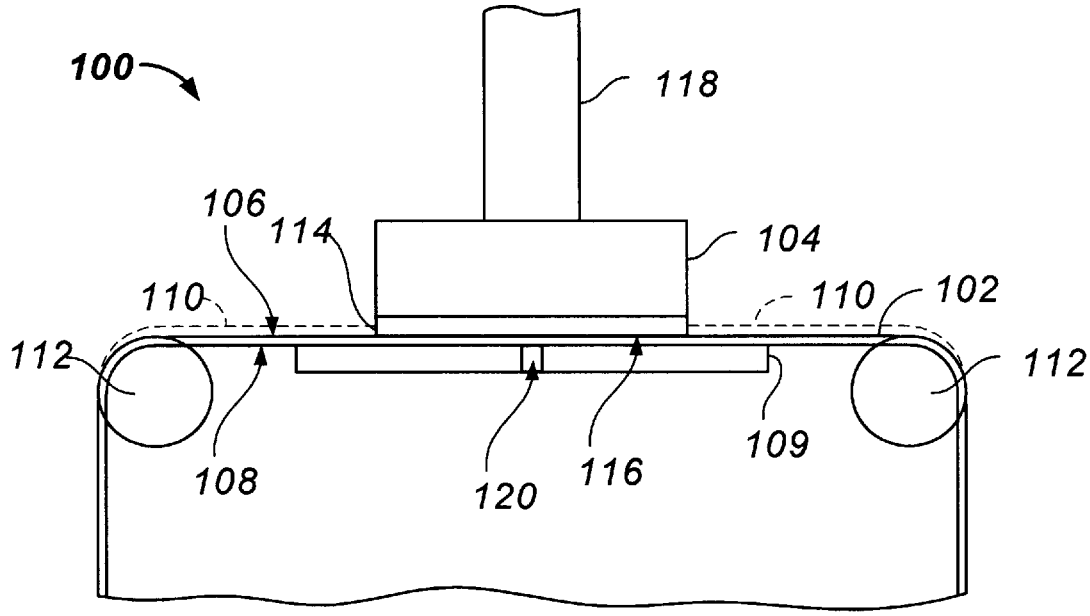
FIG. 2 is a diagram illustrating a cross sectional side view of an exemplary CNU system including an exemplary endpoint detection system according to a presently preferred embodiment used for processing workpieces such as wafers.

FIG. 2 shows an exemplary chemical mechanical polishing (CMP) apparatus 100 that includes a polishing belt 102 and a carrier head 104. The belt is also called a pad. The belt 102 includes an upper or process surface 106 and a lower surface 108. The lower surface 108 of the belt is placed and tensioned on a support plate 109 such as a platen. The belt and head are positioned so that the face of the workpiece is adjacent to the pad, which could be proximate or touching the pad. In this embodiment, the belt 102 is an optically transparent belt. A polishing solution 110 is flowed on the process surface 106 of the belt 102, and the belt is moved over a set of rollers 112 either in unidirectional or bidirectional manner by a moving mechanism (not shown). In this embodiment, the belt is moved bidirectional manner. The polishing solution 110 may be a copper polishing solution or an abrasive polishing slurry. The solution 110 may be fed from one or both sides of the wafer onto the belt, or it may also be fed onto the wafer surface through the belt, or both. A wafer 114 to be processed is held by the carrier head 104 so that a front surface 116 of the wafer, which will be referred to as surface hereinafter, is fully exposed. The head 104 may move the wafer vertically up and down as well as rotate the wafer 114 through a shaft 118. The surface 116 of the wafer 114 may have the structure shown in FIG. 1A with a copper layer 16 (that includes both the seed layer and the deposited copper) that can be polished down to the barrier layer 18 therebelow (as shown FIG. 1B), while the endpoint detection is performed in-situ using the present invention. In this example, the overburden layer is copper (Cu), the barrier layer 18 is tantalum (Ta) and the insulation layer 14 is silicon dioxide ($SiO_2$). In this embodiment, an endpoint monitoring device 120, preferably comprising an optical emitter and detector, is placed under the belt 102. The endpoint monitoring device 120 detects the polishing endpoint, when the copper layer is polished down to the barrier layer 18 on the top surface 15 of the insulation layer (see FIGS. 1A–1B). As soon as the barrier layer is exposed and detected by the device 120, the process is halted. In an optional step, if desired, the process may be continued until the barrier layer is polished down to the underlying oxide layer. As will be described below, the device 120 may be placed in a cavity in the platen 109. The device 120 of the present invention can be any optical monitoring device that is used to monitor changes in reflectivity. Although copper is used as an example material herein, the present invention may also be used in the removal of other materials, for example conductors such as Ni, Pd, Pt, Au, Pb, Sn, Ag, and their alloys, Ta, TaN, Ti and TiN, as well as insulators and semiconductors. During the process, the wafer 114 is rotated and the surface 116 is contacted by the process surface 106 of the belt 102 that is moved while the polishing solution 110 is flowed on the process surface 106 and wets the surface 116 of the wafer.

Figure 3:
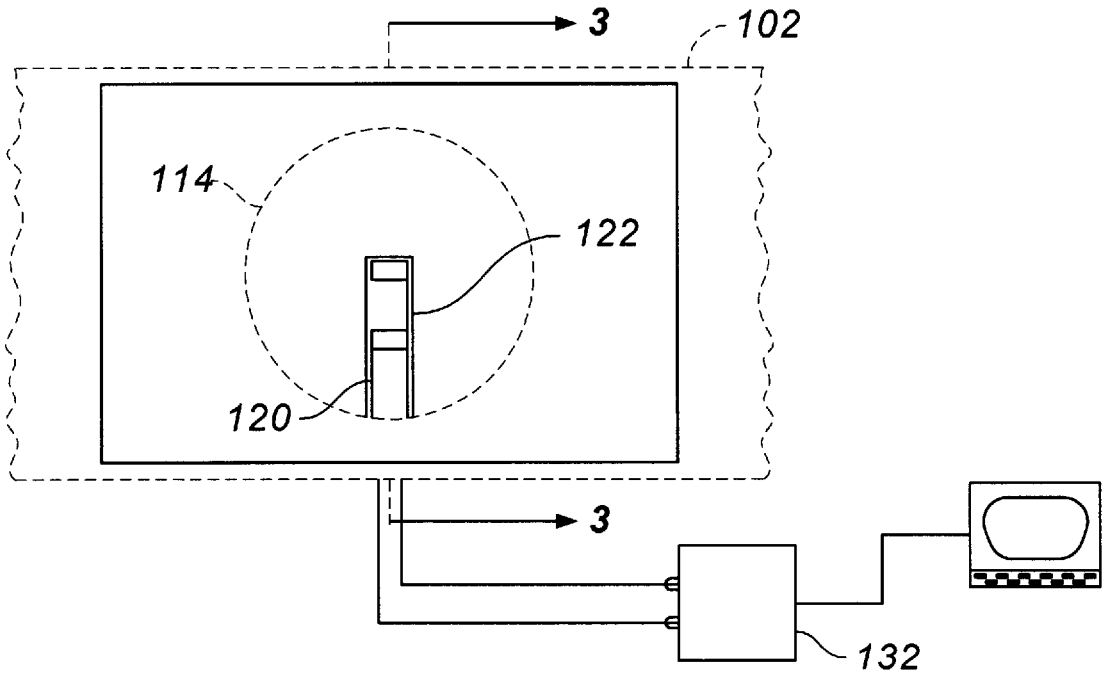
FIG. 3 is a diagram illustrating a cross-sectional top view of the exemplary CMP system of FIG. 4 and an exemplary control system for the endpoint detection system according to aspects of the present invention.
Figure 4:
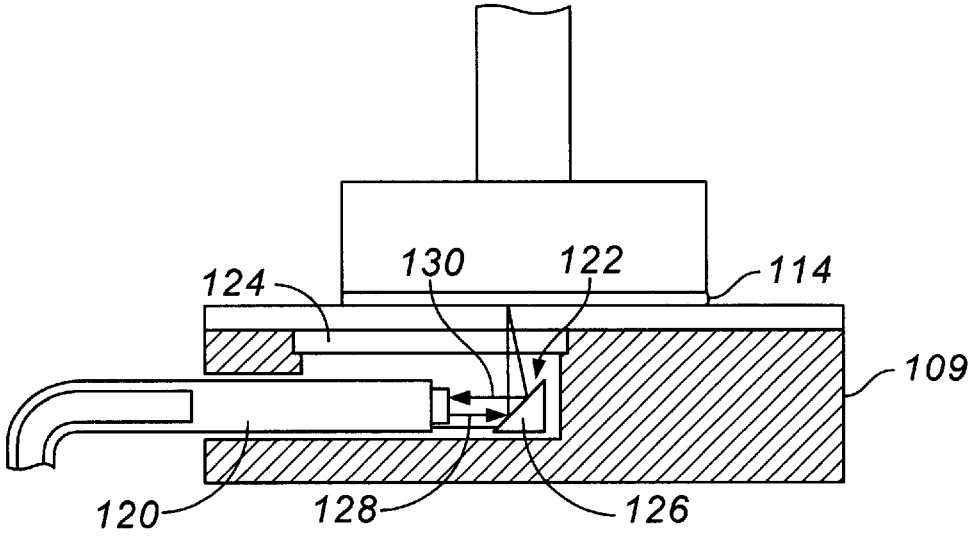
FIG. 4 is a diagram illustrating a cross sectional side view of the exemplary CMP system including the exemplary endpoint detection system of FIG. 2.

As illustrated in FIG. 3, in a plan view and also FIG. 4 in cross section, the monitoring device 120 is placed in a cavity 122 formed in the platen 109. As shown in FIG. 4, top of the cavity 122 can be sealed by a transparent window 124. In this embodiment, the cavity 122 is sized and shaped to accommodate movement of the elongate body of the monitoring device along the cavity 122. Position of the cavity 122 is correlated with the relative position of the wafer on the belt and the underlying platen. During the process, the monitoring device may be moved along the cavity by a moving mechanism (not shown) to scan the radius of the wafer. As a result of scanning action various locations between the edge of the wafer and the center of the wafer is monitored. The cavity could be extended beyond the center of the wafer so that a wide spectrum of reading can be done along, for example, the diameter of the wafer by sliding the monitoring device in the cavity so as to generate a scanning action, as the wafer is rotated. This scanning procedure can be performed as a continuous process, or in steps.

In this embodiment, a mirror 126 attached to the monitoring device enables outgoing optical signal 128 to project on the wafer surface. The mirror 126 then allows incoming reflected optical signal 130 or reflected optical signal to reach the monitoring device 120. In alternative embodiments, using monitoring devices with different configurations, such as flexible micro fibers, may eliminate the use of a mirror, and the signals may be directly sent from the device to the copper surface. The device determines endpoint, that is, the instant that the barrier layer 18 is exposed (see FIG. 1B), when the intensity of the reflected signal 130 changes. If the CMP process is continued to remove the barrier layer, the intensity of the reflected signal is again changed when the top surface 15 of the insulating layer 14 is exposed (see FIG. 1B). The optical signals generated by the monitoring device or directed by it may have wavelength range of 600–900 manometers. The outgoing optical signal may be generated by an emitter of the device 120, such as a white light emitter with a chopper or a LED or laser. According to a presently preferred embodiment, the reflected optical signal is received by a detector of the device 120. An exemplary detector can be a pyroelectric detector. Incoming optical signal may first pass through a bandpass filter set up to eliminate substantially all wavelengths but the one that is detected by the detector. In this embodiment, the outgoing and the reflected signals advantageously travels through the polishing belt which is optically transparent. Another alternative embodiment is to place an array of multiple monitoring devices fixed in the radially formed cavities extending from a center of the plate (star shape), which may correspond to the center of the wafer, to monitor the signal change on the wafer surface. Again, alternatively, a number of monitoring devices may be distributed along a single cavity. In this way, the monitoring devices may collect data from the center, middle, and edge areas of the rotating wafer surface.

According to an aspect of the present invention, the whole polishing belt is made of transparent materials and no extra window is needed for the endpoint detection. In this embodiment the belt comprises a composite structure having a top transparent abrasive layer formed on a transparent backing material. An abrasive layer contacts the workpiece during the process and includes fine abrasive particles distributed in a transparent binder matrix. An exemplary linear polishing belt structure used with the present invention may include a thin coating of transparent abrasive layer, for example 5 $\mu$m to 100 $\mu$m thick, stacked on a transparent Mylar backing, which material is available from Mipox, Inc., Hayward, Calif. The abrasive layer may be 5 $\mu$m to 100 $\mu$m thick while the backing layer may be 0.5 to 2 millimeter thick. Size of the abrasive particles in the abrasive layer are in the range of approximately 0.2 to 0.5 $\mu$m. An exemplary material for the particles maybe silica, alumina or ceria. A less transparent belt, but still usable with the present invention, is also available from 3M Company, Minnesota. While in some embodiments the belt can include abrasive particles, the belt can also be made of transparent polymeric materials without abrasive particles.

As described above, as the abrasive belt removes materials from the wafer surface and as the barrier layer or the oxide layer is exposed, the reflected light intensity changes. In one example, a transparent polishing belt having approximately 10 $\mu$m thick abrasive layer and 0.5 to 1.0 millimeter thick transparent Mylar layer was used. In this example, the abrasive layer had 0.2 to 0.5 $\mu$m fumed silica particles. A light beam (outgoing) of 675 nanometer wavelength was sent through this belt and the intensity changes throughout the CMP process were monitored. With this polishing belt, it was observed that throughout the copper removal process, the intensity of the reflected light kept an arbitrary (normalized) intensity value of 2. However, as soon as the barrier layer (Ta layer) was exposed the intensity value was reduced to 1. Further, when the barrier layer was removed from the top of the oxide layer and the oxide layer was exposed, the intensity of the reflected light was reduced to 0.5.

As shown in FIG. 3, in the preferred embodiment, the monitoring device 120 is connected to a computer 132, which computer may also be electrically connected to a carrier head controller (not shown), although it is understood that the computation could be performed in many manners, and need not necessarily require a computer with a processor, but instead could use discrete or integrated logic circuits, including but not limited to ASICS and programmable gate arrays. When operating on a copper layer with a barrier layer beneath, as soon as the barrier layer is exposed, the output signal from the monitoring device changes as a result of change in reflectivity, and the MP process is halted.

In general, the endpoint detection apparatus and methods according to aspects of the present invention are applied to one or more workpieces to detect one or more endpoints on each workpiece. For example, a CMP endpoint detection process according to an aspect of the present invention might have several CMP endpoints to be detected for a single workpiece such as a wafer. The CMP endpoints can have respective polishing sequences and respective process conditions corresponding thereto. For example, removal of the metal overburden from the surface of the wafer might represent a first CMP endpoint, and removal of the barrier layer outside of the features of the wafer might represent a second CMP endpoint. A first threshold or level of signal intensity might be used to detect the first CMP endpoint so that when the signal intensity observed by the detection system drops to at or below the first threshold or level, the first CMP endpoint is determined to have been reached. Other thresholds or level of signal intensity might be used to detect other CMP endpoints. For example, for detecting a second CMP endpoint, when the signal intensity observed by the detection system drops to at or below a second threshold or level lower than that of the first threshold or level, the second CMP endpoint would be determined to have been reached.

It is to be understood that in the foregoing discussion and appended claims, the terms "workpiece surface" and "surface of the workpiece" include, but are not limited to, the surface of the workpiece prior to processing and the surface of any layer formed on the workpiece, including conductors, oxidized metals, oxides, spin-on glass, ceramics, etc.

B. Smart Endpoint Detection System

As will be described below, the invention provides an in-situ method of both thickness uniformity control and an endpoint detection for material removal processes such as CMP. In this system, the belt may be optically transparent, or partially transparent using elements such as windows or transparent sections.

Figure 5A:
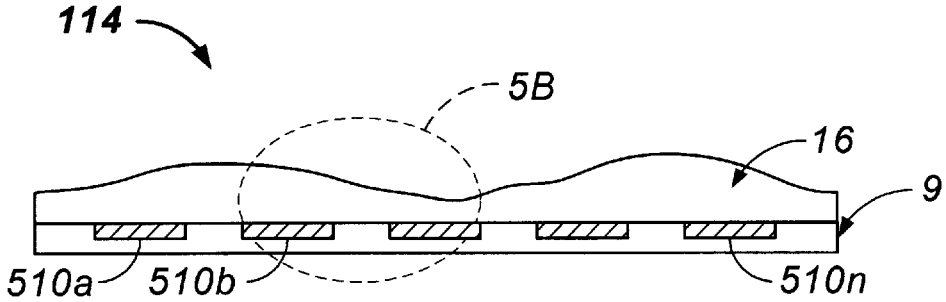
FIGS. 5A–C depict views of a workpiece surface.
Figure 5B:
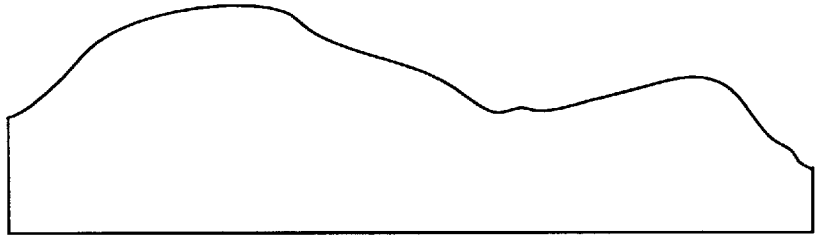
Figure 5C:
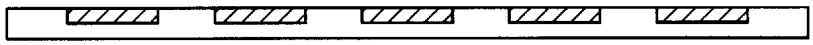

FIGS. 5A–C depict views of a workpiece surface. FIG. 5A depicts a wafer 9 after a film 16, e.g. copper, has been deposited thereover. The wafer includes a number of circuits formed in the wafer substrate 510*a*–510*n* that are shown for illustration, where n is arbitrary. Each of these circuits includes a large number of features that are filled with the deposited conductive film, often over a barrier layer. The CMP process removes the overburden and leaves the conductive film in these features. However, note that there is a global surface thickness variation that needs to be level when the overburden is removed using a process such as CMP. Since the surface varies, a process that simply polished away a predetermined thickness of the film 16 is likely to overpolish certain areas and underpolish others.

FIG. 5B depicts local surface variation on the wafer 114, which has been somewhat amplified for illustration. As mentioned above, since the surface varies, a process that simply polished away a predetermined thickness of the film 16 is likely to overpolish certain areas and underpolish others.

FIG. 5C depicts the wafer with the desired polishing endpoint where the conductive layer is in the features and the overburden is removed.

In one embodiment, the thickness uniformity detection and control system of the present invention maintains thickness uniformity of the processed surface using its real time thickness measuring capability and its control over the process parameters. Based on the derived real-time thickness data from the surface of the wafer that is processed, the thickness uniformity control system varies polishing parameters during a CMP process to uniformly polish a layer. As a result, end point of the polished layer is reached globally across the wafer surface without overpolishing and underpolishing of the subject layer. The polishing parameters may be changed by locally varying the pressure under the belt so that certain locations are polished faster than the other locations.

In one aspect of the invention, the invention maintains uniformity of the processed surface by using the detected real time endpoint data. Based on the derived real-time data from the surface of the wafer that is processed, the thickness uniformity control system varies polishing parameters during a CMP to uniformly polish a layer.

Although copper is used as an example material herein, the present invention may also be used in the removal of other materials, for example conductors such as Ni, Pd, Pt, Au, Pb, Sn, Ag, and their alloys, Ta, TaN, Ti and TiN, as well as insulators and semiconductors.

Figure 6A:
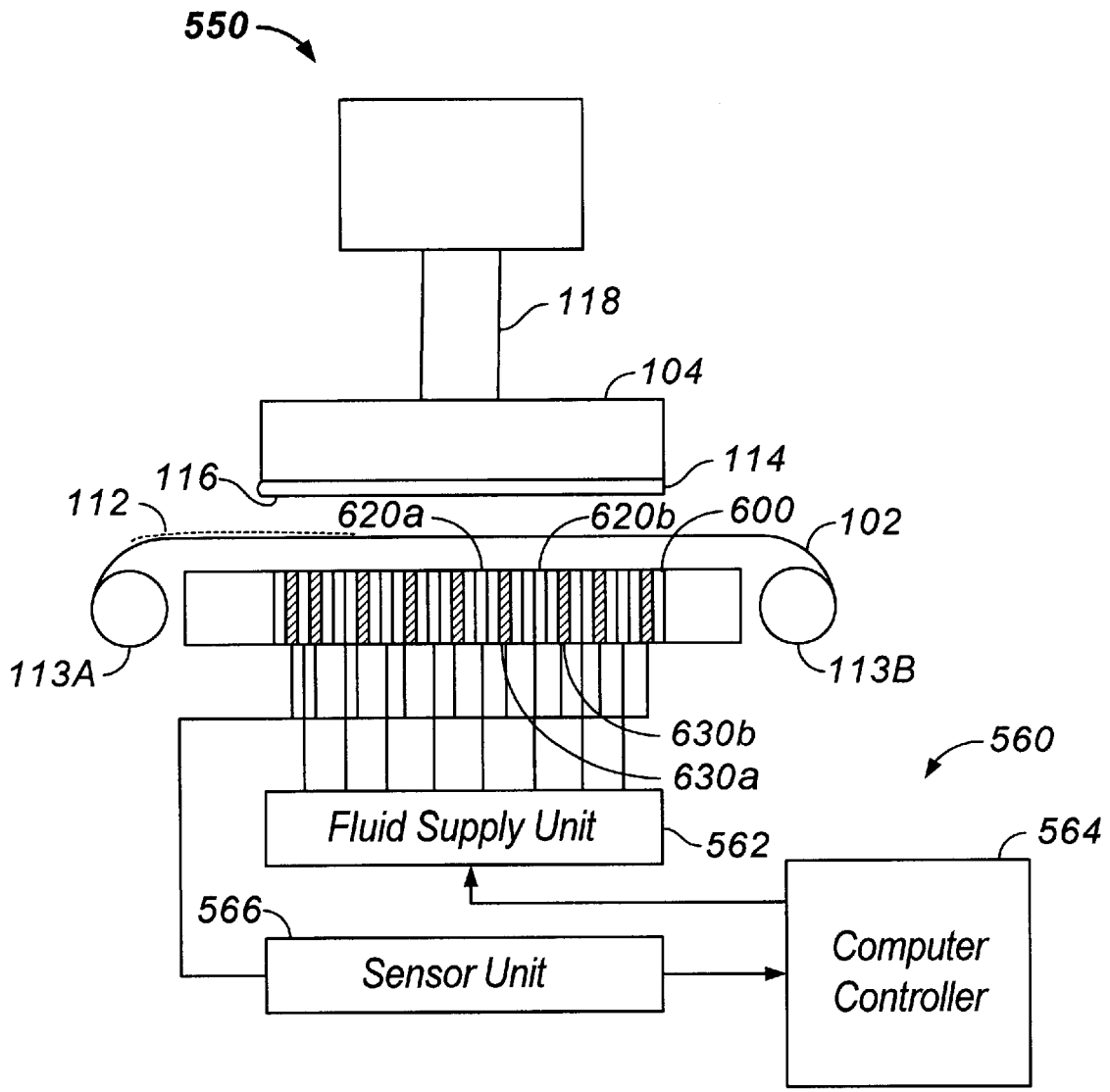
FIG. 6A depicts a workpiece processing system according to an embodiment of the invention.

FIG. 6A shows an exemplary chemical mechanical polishing (CMP) apparatus 550 with a thickness uniformity control unit 560. The CMP apparatus may further include an abrasive polishing belt 102 and a carrier head 104. The belt 102 includes an upper or process surface 106 and a lower surface 108. The lower surface 108 of the belt is placed and tensioned on a support plate 600 such as a platen. The belt preferably comprises a composite structure having a top transparent abrasive layer formed on a transparent backing material. An abrasive layer contacts the workpiece during the process and includes fine abrasive particles distributed in a transparent binder matrix. An exemplary linear polishing belt structure used with the present invention may include a thin coating of transparent abrasive layer, for example 5 $\mu$m to 100 $\mu$m thick, stacked on a transparent Mylar backing, which material is available from Mipox, Inc., Hayward, Calif. The abrasive layer may be 5 $\mu$m to 100 $\mu$m thick while the backing layer may be 0.5 to 2 millimeter thick. Size of the abrasive particles in the abrasive layer are in the range of approximately 0.2–0.5 $\mu$m.

Figure 6B:
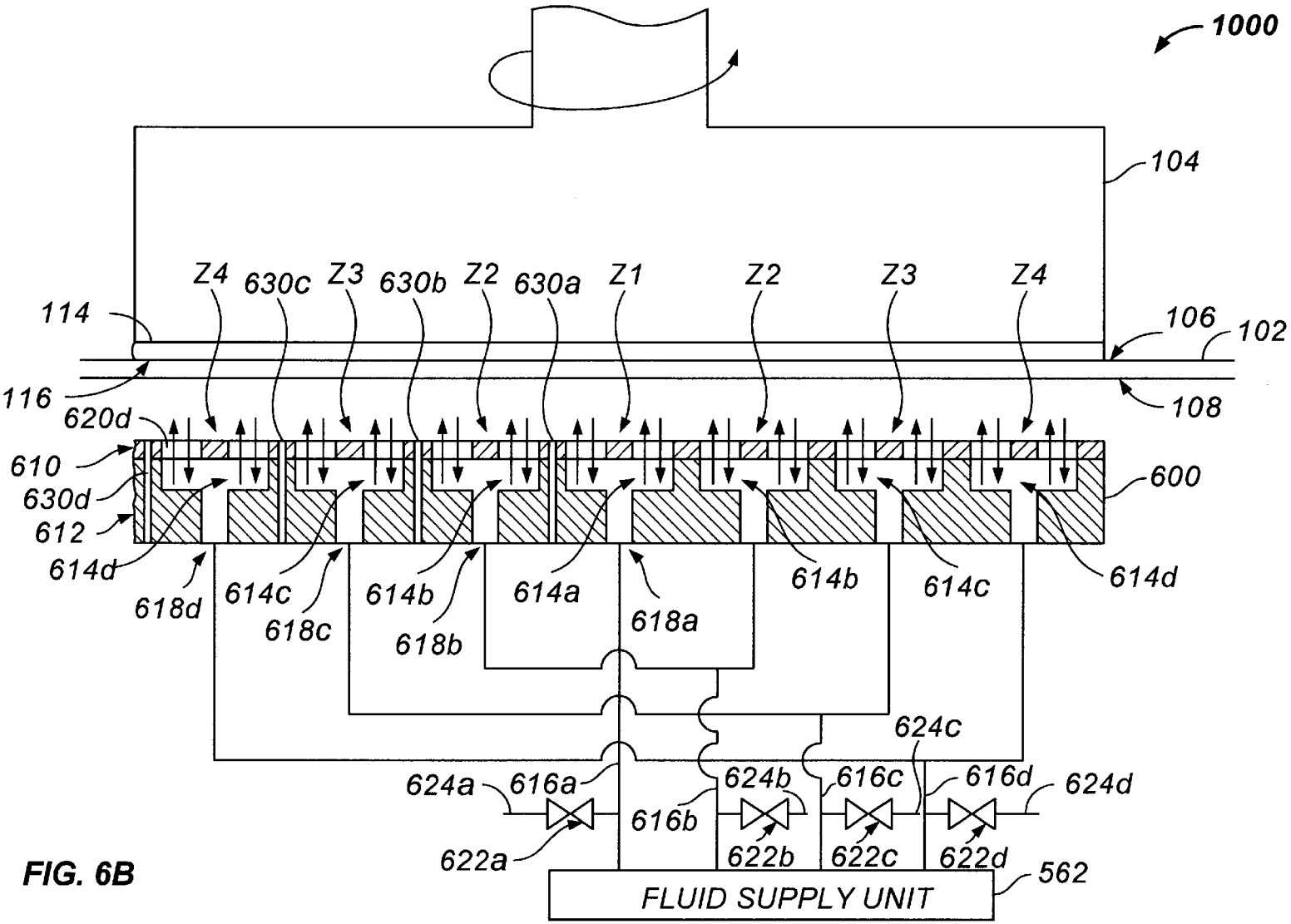
FIG. 6B depicts a workpiece processing system according to another embodiment of the invention.

The platen includes a plurality of holes 620*a*–620*n* which are shown in more detail in FIG. 6B (Also see FIGS. 7A–7B) for generating a fluid pressure under the belt during the process. The belt 102 may be replaced with non-abrasive belt, if a CMP slurry or polishing solution including abrasives is used. The holes 620*a*–620*n* are connected to a fluid supplied by fluid supply unit 562. In this embodiment, the belt 102 is an optically transparent belt, but can also be a belt that had windows therein or is composed of portions that are optically transparent.

The polishing pad, or belt, is selected to have sufficient flexibility to conform to the applied pressure and communicate a related local pressure against the wafer surface. The exemplary embodiments use a flexible polymer pad that adequately transmits pressure to local areas. If the pad is insufficiently flexible, e.g. reinforced with a steel belt, the pressure will be communicated over a large area and the system may continue to polish undesired areas of the wafer.

A polishing solution 112 is flowed on the process surface 106 of the belt 102, and the belt is moved over a set of rollers 113 either in unidirectional or bidirectional manner by a moving mechanism (not shown). In this embodiment, the belt is preferably moved bi-directional manner. The polishing solution 112 may be a copper polishing solution or an abrasive polishing slurry. The solution 112 may be fed from one or both sides of the wafer onto the belt, or it may also be fed onto the wafer surface through the belt, or both. A wafer 114 to be processed is held by the carrier head 104 so that a front surface 116 of the wafer, which will be referred to as surface hereinafter, is fully exposed. The head 104 may move the wafer vertically up and down as well as rotate the wafer 114 through a shaft 118. The surface 116 of the wafer 114 may initially have the structure shown in FIG. 5A with a copper layer 16 (that includes both the seed layer and the deposited copper) that can be polished down to an endpoint (as shown FIG. 5C), while the below thickness uniformity detection and control process of the present invention is in-situ performed. At this point, process may also be continued with a barrier layer removal step so that the barrier layer on top surface 15 of the insulation layer is polished away until the insulation layer 14 is exposed or the Barrier layer endpoint reached. In this example, the overburden layer is copper (Cu), the barrier layer 18 is tantalum (Ta) and the insulation layer 14 is silicon dioxide ($SiO_2$).

Figure 7A:
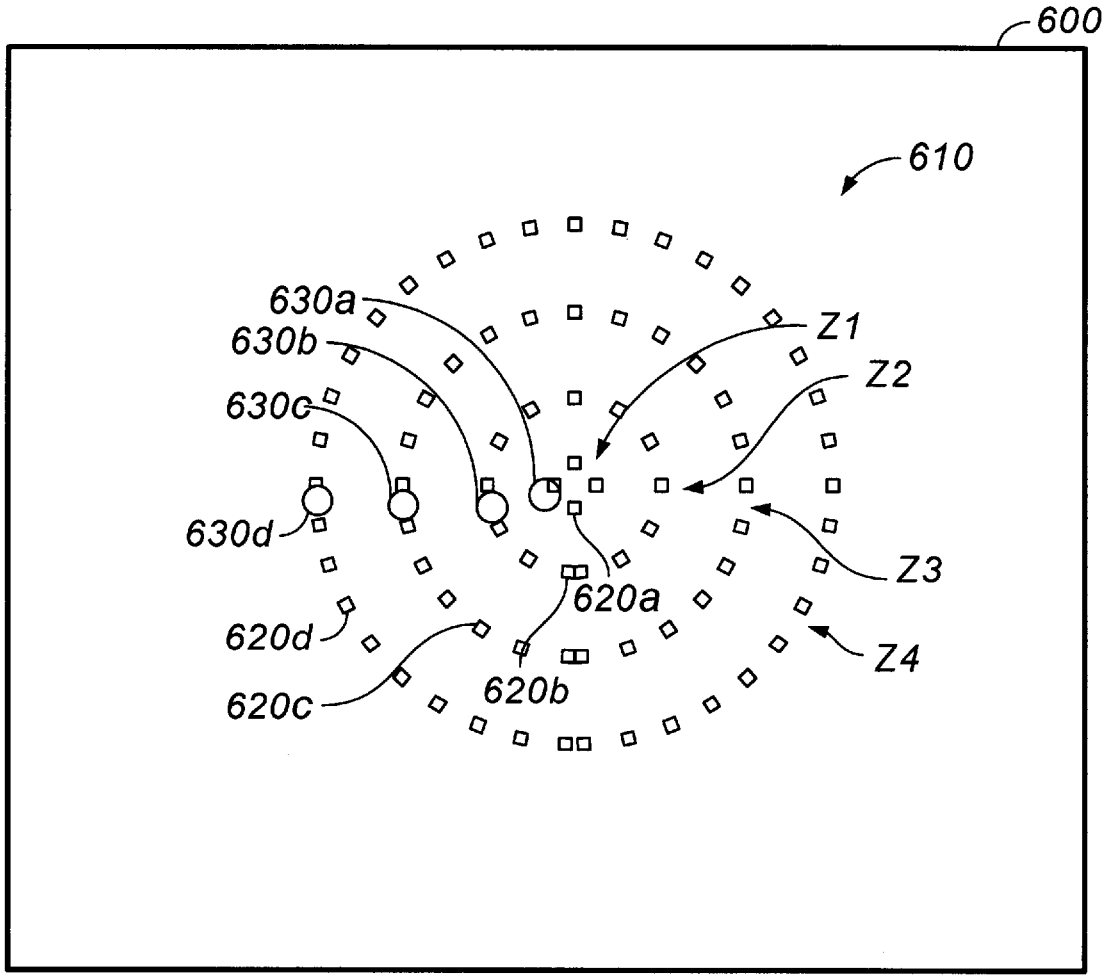
FIGS. 7A–B depict the platen of FIGS. 6A–6B according to an embodiment of the invention.
Figure 7B:
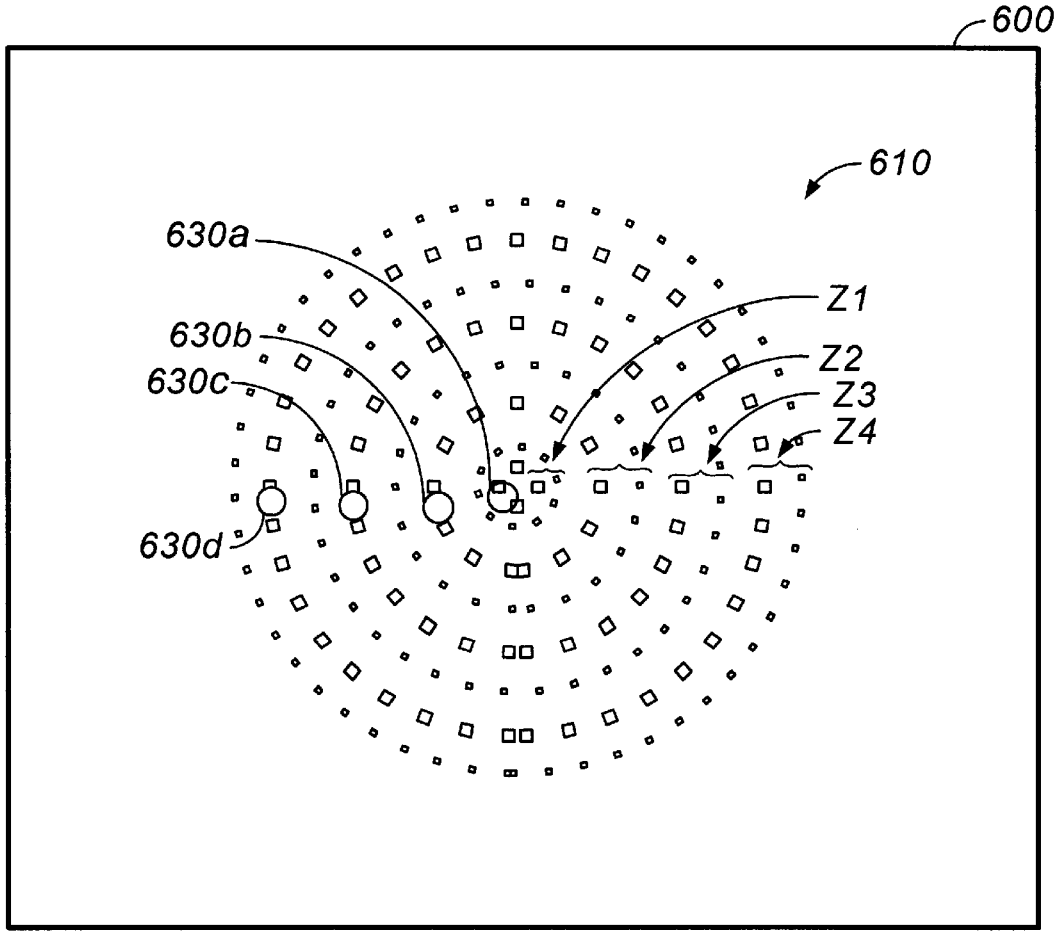

The uniformity control unit includes a fluid supply unit 562 for delivering the fluid (e.g. air) to the platen 600. The uniformity control unit also includes a computer controller 564 with a CPU, memory, monitor, keyboard and other common elements. The computer 564 is coupled to a series of exemplary sensors 630*a*–630*n*, where n is an arbitrary sensor identifier (630*a*–630*d* are also shown in FIGS. 6B and 7A–7B) through a sensor controller 566. The sensors 630*a*–630*n* are disposed in the platen adjacent to fluid holes 620*a*–620*n* in the platen. In this embodiment, holes of the platen are preferably grouped in certain manner, for example distributing each group of holes in a circular manner (see FIGS. 6B, 7A–7B). The exemplary sensors may comprise thickness sensors and endpoint detection sensors. As will be described below, each group of holes (known as pressurezones) are connected to the fluid supply unit that delivers fluid pressure controlled by computer controller 564. The fluid supply unit is capable of varying the fluid pressure (as fluid flow) for each pressure zone independently of one another.

In one aspect of the invention, the sensors 630*a*–630*n* are endpoint sensors comprising an optical emitter and detector placed under the belt. The endpoint sensor detects the polishing endpoint, when for example the copper layer is polished down to the barrier layer 18 on the top surface 15 of the insulation layer (see FIGS. 1A–1B).

As explained above, the present invention uses the ability to control local pressure from the different zones of the platen to increase or decrease the local polishing rate on the wafer. Accordingly, one key aspect of the invention is the ability to provide different polishing rates by employing different pressure zones on the platen. Polishing sensitivity of this system is improved by tightly controlling fluid or air pressure levels on each individual pressure zone. Establishing precisely controlled pressure levels for the pressure zones, in turn, results in greater control of local polishing rates on the wafer.

As shown in FIG. 6B, in the preferred embodiment, such discrete pressure zones having predetermined pressure levels may also be achieved by removal of the excess air from the top of the plate. As will be described more fully below, by allowing controlled leaks to the atmosphere or a vacuum source, present invention regulates the blown excess air that would flow over neighboring pressure zones, i.e., regulating cross-talk between the neighboring zones, and cause changes in air pressure level in the neighboring zones. FIG. 6B shows the exemplary system 550 with air leak valves. In this embodiment computer controller and sensor unit are not shown for the purpose of clarity. The system is mainly comprised of platen 600, wafer carrier 104 to hold the wafer 114 to process, and polishing belt 102 or polishing pad. As described above, the belt 102 has top surface 106 or a process surface and back surface 108. Front surface 116 of the wafer 114 faces to the top surface of the polishing belt 102. Specifics of the polishing belt and the polishing solutions are exemplified above, and therefore, for clarity, their description will not be repeated herein.

In comparison to FIG. 6A, FIG. 6B shows the platen 600 in more detail. As shown in FIG. 6B, the platen 600 may have an upper surface 610 enclosing a base block 612. The upper surface is divided into concentric pressure zones, namely first zone z1, second zone z2, thirds zone z3 and fourth zone z4. Such concentric zones are also exemplified in FIGS. 7A–7B. Zones z1-z4 include holes 620*a*–620*n*. As shown in FIG. 6B, each zone may comprise two or more holes. For example, the first zone z1 includes holes 620*a* and so on. Sensors 630*a*–630*n* are also placed in each zone. For clarity FIG. 6B does not include computer controller and sensor unit and connections to this unit (see FIG. 6A). Further, each zone in the surface 610 corresponds to an air chamber 614*a*–614*d* as in the manner shown in FIG. 6B. For example holes 620*a* in the first zone z1 is fed by the air flowing through the chamber 614*a*, the holes 614*b* in the second zone z2 is fed by air flow from the chamber 614*b* and so on. Chambers 614*a*–614*d* are formed as circular concentric grooves which are connected to an air supply unit 562 via air lines 616*a*–616*d* respectively. Each air line 616*a*–616*d* is connected to the corresponding chamber through one or more air ports 618*a*–618*d*. Further, by employing connectors, for example T-connectors, each air line 616*a*–616*d* is coupled to pressure control devices 622*a*–622*d* respectively. In this embodiment, pressure control devices are air valves 622*a*–622*d* connected to air lines 616*a*–616*d*. In this respect, each valve is associated with one of the pressure zones, for example, the first valve 622 is for the first zone z1, and the second valve 622B is for the second zone z2 and so on.

The valves 622*a*–622*d* include ventilation ports 624*a*–624*d*. The ventilation ports 624*a*–624*d* may be connected to out side atmosphere or vacuum (not shown) for removal of the vented air from the system 1000. In this embodiment, through the valves, it is possible to adjust amount of the air that may be vented out from the ventilation ports 624*a*–624*d* and thereby adjust the positive pressure on a pressure zone. When the valves 622*a*–622*d* are switched on, they vent out a percentage of the air that is flowing through the lines 616*a*–616*d*. In this respect, valves 616*a*–616*d* can be used create a positive pressure or a negative pressure or zero pressure in the zones. With a vacuum connection, a negative pressure or a zero pressure can be created on the pressure zone.

However, the most important function of a valve is to vent out air to adjust pressure level in a pressure zone that the valve is associated with, when excess air from neighboring zones flows over the zone and cause air pressure increase on that zone. In this embodiment, the air supply unit is capable of supplying same air flow rate to each pressure zone as well as varying flow rates to individual pressure zones to establish an air zone, having a predetermined air pressure profile, under the polishing belt 102.

FIGS. 7A–7B show the surface 610 in plan view with zones z1-z4 including the holes 620*a*–620*n* and the sensors 630*a*–630*n*. In this embodiment, the exemplary sensors 630*a*–630*n* may be optical endpoint sensors, preferably comprising an optical emitter and detector, and are disposed in the platen under the polishing pad from the workpiece. For example, sensors 630*a*–630*n* may be located in or near the zones z1-z4 which represents a pressure zone where the fluid pressure is selectively controlled by the fluid supply unit 562. Although in this embodiment exemplary optical sensors, which are located in the platen, are used, any type of sensors that are located in any suitable position in the system can be used and is within the scope of the present invention. As shown in FIG. 7B, each zone may comprise a plurality of concentric circles, and it is further anticipated that in some cases a zone may not have a sensor. The sensor unit 566 receives the raw sensor signals (e.g. reflected light) and creates electrical sensor signals that are sent to the computer 564 (see FIG. 6A), which controls the fluid supply unit 562 in the manner described above.

Figure 8:
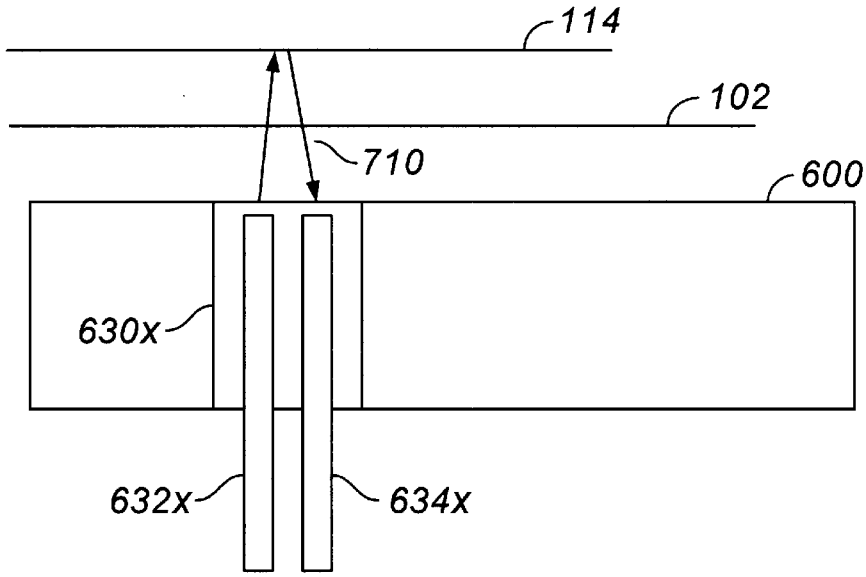
FIG. 8 is an exploded view of a sensor according to an embodiment of the invention.

The endpoint sensors of the invention can be any optical monitoring device that is used to monitor changes in reflectivity of the polished layer. Referring to FIG. 8, each sensor 630*x* includes a send fiber 632*x* that provides a light that is reflected off the workpiece 114 (see reference number 710) and a receive fiber 634*x* that receives the reflected light. The endpoint sensor detects the polishing endpoint by the change in reflected light, when for example the copper layer is polished down to the barrier layer 18 on the top surface 15 of the insulation layer (see FIGS. 1A–1B). In this aspect, the outgoing and the incoming signals travels through the optically transparent polishing belt 102. Use of such sensors in CMP endpoint detection is disclosed in U.S. application Ser. No. 10/052,475, filed Jan. 17, 2002.

CMP is a process that polishes away a surface based roughly on the equation:

$$\text{Polishing Rate}=\text{Constant}\times\text{Velocity}\times\text{Pressure}.$$

The invention uses the ability to control local pressure to increase or decrease the local polishing rate. Consequently, one key aspect of the invention is the ability to employ different polish rates in different pressure zones.

Figure 9A:
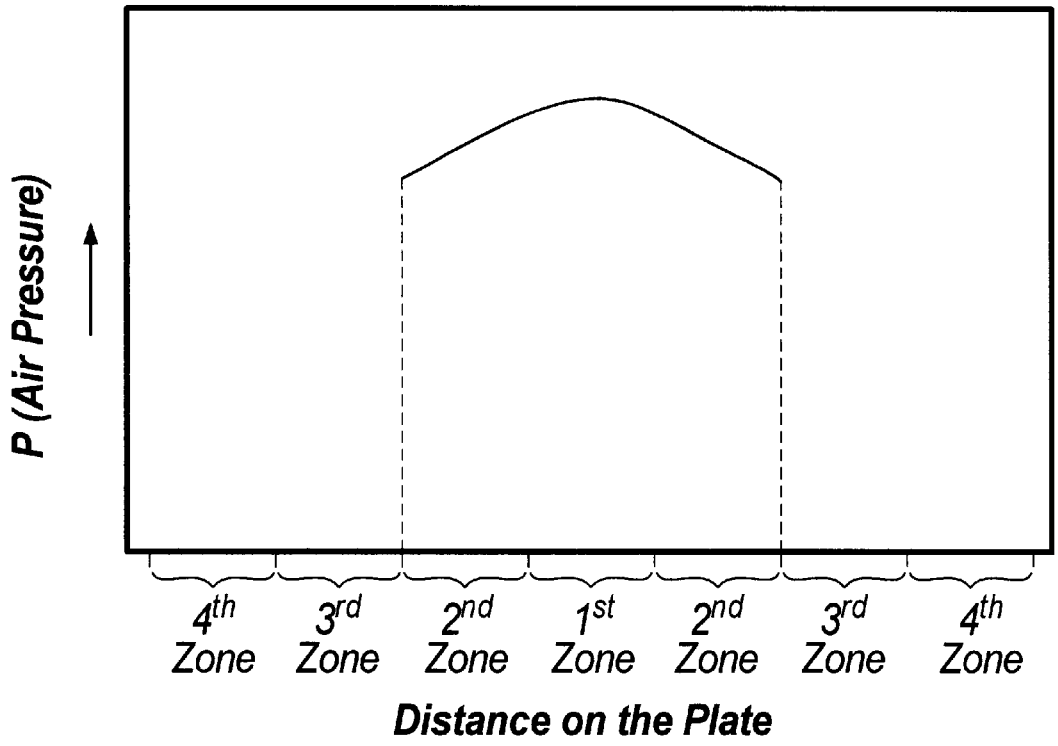
FIGS. 9A–9B depict pressure profiles obtained with process of the present invention.

One operation sequence may be exemplified using pressure zones z1 and z2 to establish pressure profile shown in FIG. 9A. It is understood that use of two zones is for the purpose of exemplification. A pressure profile similar to the one in FIG. 9A can be formed using the pressure zones z1, z2, z3 and z4. The pressure profile shown in FIG. 9A can be established by having a high air pressure P1 in the first zone z1 but a lower air pressure in the surrounding second zone z2. In operation, this may be for example performed by first establishing pressure P1 in the fist zone z1 with a first predetermined amount of air flow to the first zone z1 from the air supply unit. During the establishment of pressure P1, the first valve 622*a* may be either adjusted to vent a fraction of the first air flow from the first line 616*a*. Establishment of pressure P2 in the second zone z2 may for example be done by flowing the first predetermined amount of air flow through the second air line 616*b* while lowering the pressure to P2 by venting a portion of the first predetermined air flow through the venting port 624*b*. At this point any air flow from the first zone to the second zone may increase the pressure in the second zone to a P3 pressure. In accordance with the present invention, the increase in pressure level in the second zone z2 is reversed by venting more air from the first predetermined flow via the second valve. As a result of venting, a reduction in the amount of first flow that is directed to the second zone occurs and the pressure level in the second zone z2 recovers back to P2 pressure level. The same process may be performed using different air flows for each zones. In this case, the pressure levels are again adjusted by venting predetermined amounts of the air flows.

Figure 9B:
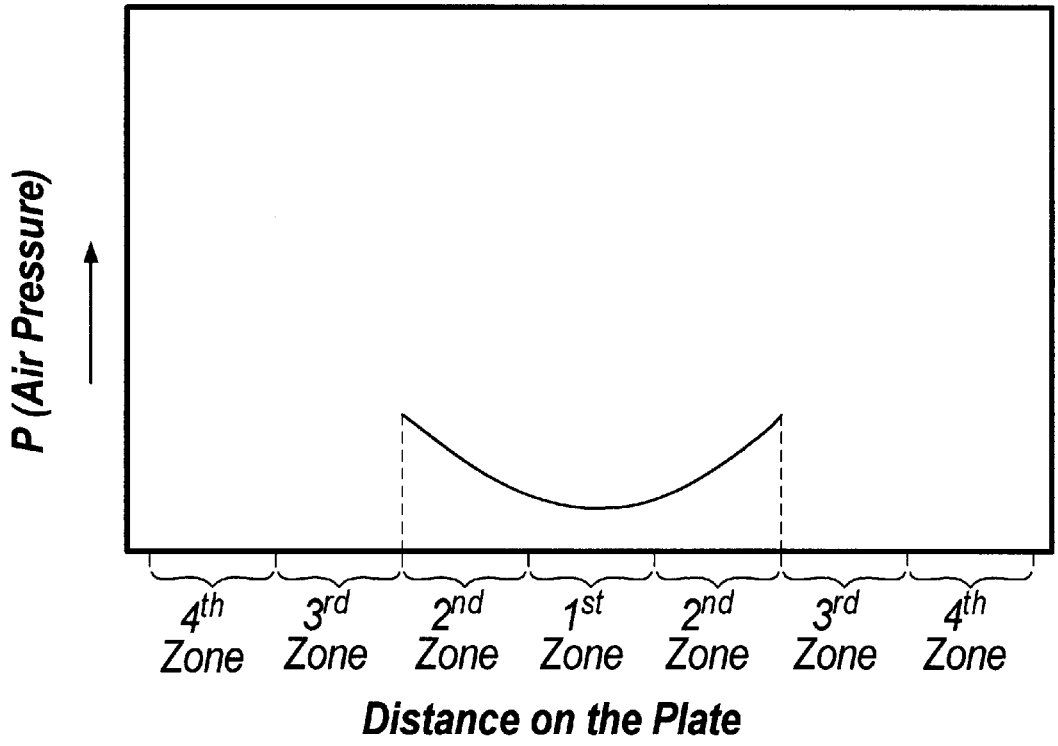

Another operation sequence may be exemplified using also zones z1 and z2 to establish pressure profile shown in FIG. 9B. A pressure profile similar to the one in FIG. 9B can be formed using the pressure zones z1, z2, z3 and z4. The pressure profile shown in FIG. 9B can be established by having a low air pressure P1 in the first zone z1 but a higher air pressure P2 in the surrounding second zone z2. In operation, this may be for example performed by first establishing pressure P2 in the second zone z2 with a first predetermined amount of air flow to the second zone z2 from the air supply unit 562. During the establishment of pressure P2, the second valve 622*b* may be either switched off or switched on to vent a fraction of the first air flow. Establishment of pressure P1 in the first zone z1 may for example be done by flowing the first predetermined amount of air flow through the first air line 616*a* while lowering the pressure to P1 level by venting a predetermined portion of the first predetermined air flow through the venting port 624*a*. At this point any air flow from the second zone z2 to the first zone z1 may increase the pressure in the first zone z1 to a P3 pressure. As in the previous case, the increase in pressure level in the first zone z1 is reversed by venting more air from the first predetermined flow via the first valve 622*a*. As a result of venting, a reduction in the amount of first flow that is directed to the first zone z1 occurs and the pressure level in the first zone recovers back to P1 pressure level. The same process may be performed using different air flows for each zones. In this case, the pressure levels are again adjusted by venting predetermined amounts of the air flows. These processes described in connection with FIGS. 9A–9B may also be controlled dynamically. For example, valves may be controlled or regulated with inputs from the pressure sensors placed within each pressure zones z1-z4 shown in FIG. 6B. When the pressure in one zone, due to air flow from the neighboring zones, increases, the valve vents predetermined amount of air to adjust air pressure on that zone. Ventilation through the valves can be controlled by a controller that receives pressure input from the sensors.

Figure 10A:
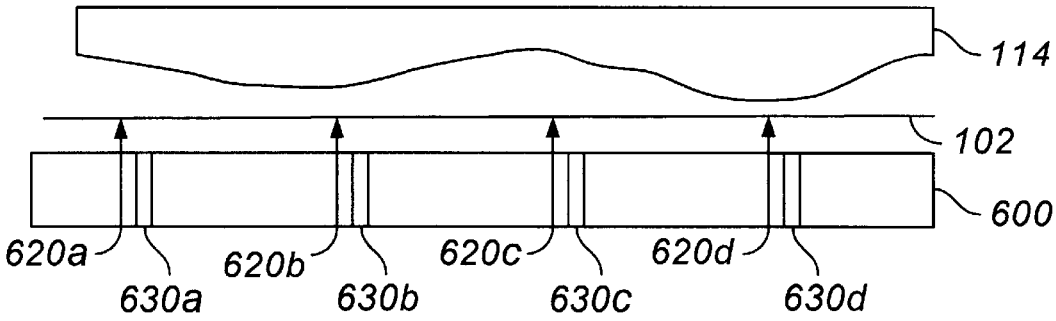
FIGS. 10A–C depict polishing a workpiece according to an embodiment of the invention.
Figure 10B:
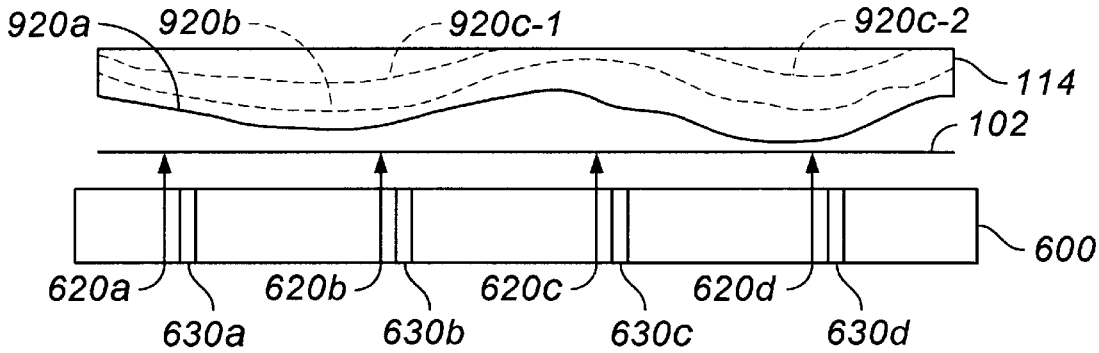
Figure 10C:
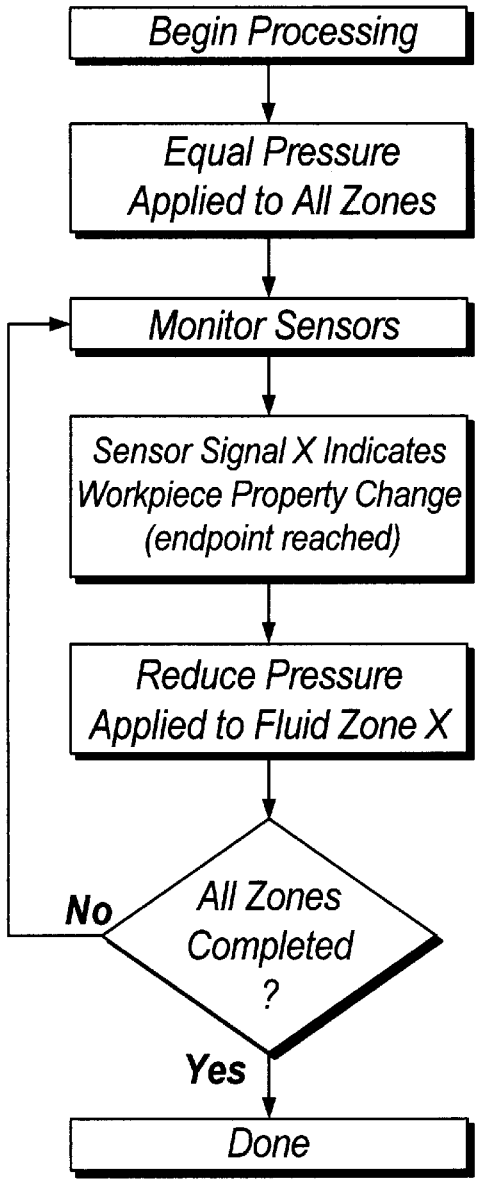

When operating on a copper layer with a barrier layer beneath, as soon as the barrier layer is exposed, the signal from the endpoint sensor changes as a result of change in reflectivity. Referring to FIGS. 10A–10C, in the exemplary process, one area of the wafer may need more polishing than another area, or one area may thin down faster than another area and thus the copper endpoint may be reached for one area faster than for another area. As soon as the copper endpoint is detected by the endpoint sensors, the air pressure in that pressure zone is reduced to slow down or eliminate further polishing in that area. Alternately, the air pressure may be increased in other areas that have not yet reached endpoint. With the difference in removal rate, the copper at the finished area is not substantially removed any longer and the other areas can continue to be polished. The aspect of the invention here is the difference of air pressure applied to pressure zones based on their status regarding endpoint.

FIGS. 10B–10C depict an example of smart endpoint detection. As shown in FIG. 10B, the workpiece surface is defined by reference 920*a*. After some polishing time, the surface is reduced to reference 920*b* and the layer is very thin near the zone close to sensor 630*c*. After more polishing time, when the surface is polished down to reference 920*c* (920*c*-1 and 930*c*-2), sensor 630*c* will detect a change in the surface and controller 560 will reduce the pressure (fluid flow rate) to that zone. Consequently, that zone will experience less polishing, while the other zones continue to bc polished at the original rate. Of course, it is also anticipated that the fluid flow could be increased to certain unfinished zones, if so desired. Once all the zones are polished (all the sensors report the endpoint is reached), then the process is completed.

Although various preferred embodiments have been described in detail above, those skilled in the art will readily appreciate that many modifications of the exemplary embodiment are possible without materially departing from the novel teachings and advantages of this invention.

C. Alternate Embodiments

Acoustic sensors can be used in place of the optical sensors described above. In one embodiment, the sensors 630*a*–630*n* detect the thickness of the polished layer in real-time, while the wafer is processed, and supply this information to the computer through the sensor unit 566. The computer 564 then evaluates the supplied thickness data and, if non-planarity in the removed layer is detected, selectively readjusts the material removal rates by varying one or more polishing parameters, such as air pressure under the belt or slurry compositions, on the wafer to obtain thickness uniformity across the wafer surface.

Figure 11:
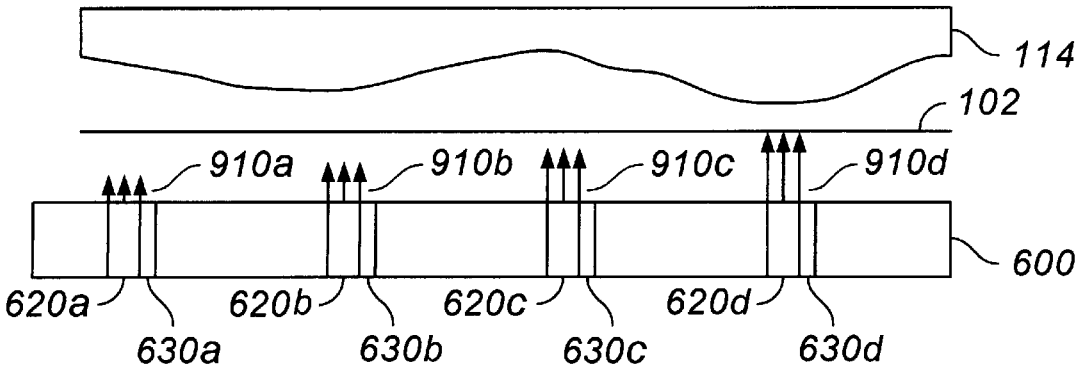
FIG. 11 depicts polishing a workpiece according to an embodiment of the invention showing different force vectors depending on the workpiece profile.

FIG. 11 depicts polishing a workpiece according to an embodiment of the invention showing different pressure vectors 910*a* to 910*d* depending on the workpiece profile. The longer arrows represent a greater force. If a workpiece zone needs more polishing, then computer controller instructs the fluid supply unit to provide increased pressure on that zone. Likewise, when a zone does not need additional polishing, then computer controller instructs the fluid supply unit to provide less pressure on that zone.

D. Conclusion

Advantages of the invention include the ability to provide optimal workpiece polishing to a selected endpoint.

Having disclosed exemplary embodiments and the best mode, modifications and variations may be made to the disclosed embodiments while remaining within the subject and spirit of the invention as defined by the following claims.

What is claimed is:

1. A polishing apparatus for polishing a workpiece comprising:

a workpiece holder configured to hold the workpiece;

a flexible polishing pad configured to be positioned adjacent to a face of the workpiece in order to polish the workpiece with a front side of the polishing pad;

a platen having a plurality of holes positioned on a back side of the polishing pad and configured to supply and exhaust a fluid through the holes to selectively apply pressure to the polishing pad thereby causing the polishing pad to contact the workpiece with selective pressure;

a plurality of sensors disposed in the platen and configured to detect a property of the workpiece surface and generate a plurality of sensor signals responsive thereto; and a fluid controller coupled to the sensors and configured to adjust the fluid pressure based at least in part of the sensor signals.

2. The apparatus of claim 1, further comprising a number of pressure control devices coupled between the plurality of holes and fluid controller so as to control the pressure of the fluid.

3. The apparatus of claim 2, wherein: the plurality of holes are divided into a plurality of pressure zones; at least one sensor is associated with each pressure zone; and the fluid controller is configured to selectively apply pressure to the pad for each pressure zone.

4. The apparatus of claim 1, wherein: the polishing pad is a belt that is configured to move in a bi-directional linear motion.

5. The apparatus of claim 3, wherein one pressure control device is coupled to each pressure zones.

6. The apparatus of claim 5, wherein the pressure control device is a valve.

7. The apparatus of claim 6, wherein the fluid is air.

8. The apparatus of claim 3, wherein the pressure control device is capable of applying negative and positive pressures to each pressure zone.

9. The apparatus of claim 3, wherein the pressure control device maintains selected pressures in each pressure zone by leaking air through the pressure control device.

10. A method of polishing a workpiece using an apparatus having a flexible polishing pad, a platen with holes therein for supplying and exhausting a fluid to selectively apply pressure on the pad, a plurality of sensors for detecting a property of the workpiece surface and a fluid controller, comprising the steps of:

holding the workpiece in position adjacent to the pad;

positioning the pad adjacent to a face of the workpiece in order to polish the workpiece with a front side of the polishing pad;

supplying and exhausting a fluid through the holes of the platen to selectively apply pressure to the polishing pad thereby causing the polishing pad to contact the workpiece with selective pressure;

sensing to detect a property of the workpiece surface and generate a plurality of sensor signals responsive thereto; and adjust the fluid pressure based at least in part of the sensor signals.

11. The method of claim 10 further comprising the step of maintaining the fluid pressure at a selected pressure level.

12. The method of claim 11, wherein the plurality of holes are divided into a plurality of pressure zones, at least one sensor is associated with each pressure zone, the method further comprising the step of:

selectively applying pressure to the pad for each pressure zone.

13. The method of claim 12, the step of maintaining is performed using pressure control devices that are placed between the fluid controller and each pressure zone.

14. The method of claim 13, the step of maintaining is performed by pressure control devices by leaking air to the atmosphere.

15. The method of claim 10, wherein the polishing pad is a belt, and: the moving step includes the step of moving the pad in a bi-directional linear motion.

16. The apparatus of claim 13, wherein the pressure control devices are capable of applying negative and positive pressures to each pressure zone.

17. The method of claim 10 further comprising the step of moving the pad over the platen.

18. A method of polishing a workpiece using an apparatus having a polishing pad, a platen with holes therein for supplying and exhausting a fluid to selectively apply pressure on the pad, comprising the steps of:

holding the workpiece in position adjacent to the pad;

positioning the pad adjacent to a face of the workpiece in order to polish the workpiece with a front side of the polishing pad; and supplying and exhausting a fluid through the holes of the platen to selectively apply pressure to the polishing pad thereby causing the polishing pad to contact the workpiece with selective pressure.

19. The method of claim 18, wherein the plurality of holes are divided into a plurality of pressure zones, the method further comprising the step of:

selectively applying pressure to the pad for each pressure zone.

* * * * *

UNITED STATES PATENT AND TRADEMARK OFFICE

CERTIFICATE OF CORRECTION

PATENT NO. : 6,722,946 B2
APPLICATION NO. : 10/197090
DATED : April 20, 2004
INVENTOR(S) : Talieh et al.

It is certified that error appears in the above-identified patent and that said Letters Patent is hereby corrected as shown below:

Claim 5, at column 15, line 35, please delete “zones” and replace with -- zone --

Claim 10, at column 16, line 9, please delete “adjust” and replace with -- adjusting --

Claim 10, at column 16, line 9, please delete “of” and replace with -- on --

Signed and Sealed this

Twenty-eighth Day of August, 2007

JON W. DUDAS
*Director of the United States Patent and Trademark Office*